US007170505B2

(12) United States Patent
Akahori

(10) Patent No.: US 7,170,505 B2
(45) Date of Patent: Jan. 30, 2007

(54) DISPLAY APPARATUS DRIVE CIRCUIT HAVING A PLURALITY OF CASCADE CONNECTED DRIVER ICS

(75) Inventor: Hideki Akahori, Kanagawa (JP)

(73) Assignee: NEC Electronics Corporation (JP)

( * ) Notice: Subject to any disclaimer, the term of this patent is extended or adjusted under 35 U.S.C. 154(b) by 527 days.

(21) Appl. No.: 10/766,218

(22) Filed: Jan. 27, 2004

(65) Prior Publication Data

US 2004/0183794 A1 Sep. 23, 2004

(30) Foreign Application Priority Data

Jan. 29, 2003 (JP) ..... 2003/021080

(51) Int. Cl.
*G09G 5/00* (2006.01)

(52) U.S. Cl. ..... 345/204; 345/100; 345/208; 327/276

(58) Field of Classification Search ..... 345/87–95, 345/98–101, 204–205, 208–214; 713/158–166, 713/276

See application file for complete search history.

(56) References Cited

U.S. PATENT DOCUMENTS

| | | | | |
|---|---|---|---|---|
| 6,426,985 | B1 * | 7/2002 | Iwata et al. | 375/371 |
| 6,697,041 | B1 * | 2/2004 | Tamai et al. | 345/100 |
| 6,748,549 | B1 * | 6/2004 | Chao et al. | 713/401 |
| 7,088,350 | B2 * | 8/2006 | Miyazawa | 345/204 |
| 2003/0184354 | A1 * | 10/2003 | Higuchi | 327/158 |

FOREIGN PATENT DOCUMENTS

| | | |
|---|---|---|
| JP | 8-237091 | 9/1996 |
| JP | 10-153760 | 6/1998 |
| JP | 2001-202052 | 7/2001 |
| JP | 2001-324967 | 11/2001 |
| JP | 2001-324987 | 11/2001 |
| JP | 2001-331150 | 11/2001 |
| JP | 2002-0003275 | 1/2002 |
| JP | 2002-23710 | 1/2002 |

OTHER PUBLICATIONS

Untranslated Office Action issued by Japanese Patent Office on Nov. 15, 2005 in in connection with corresponding Japanese application No. 2003-021080.

(Continued)

*Primary Examiner*—Richard Hjerpe
*Assistant Examiner*—Mansour M. Said
(74) *Attorney, Agent, or Firm*—Ostrolenk, Faber, Gerb & Soffen, LLP

(57) ABSTRACT

To prevent a timing shift of a clock and data supplied to a driver IC.

A driver 1011 includes a phase adjustment circuit 201 for receiving via input terminals a clock and data outputted from a controller 103, latching received data with the clock adjusted to a 50-percent duty ratio, and outputting as phase-adjusted signals the data having the latched data further latched by synchronizing it with a delay clock having the duty-ratio-adjusted clock delayed by ($\pi/2$) and the clock of the 50-percent duty ratio.

11 Claims, 8 Drawing Sheets

OTHER PUBLICATIONS

English translation of Japanese Office Action dated Nov. 15, 2005 issued in connection with corresponding Japanese application No. 2003-021080.

Japanese translation of Office Action issued by Korean Patent Office on Sep. 29, 2005 in connection with corresponding Korean application No. 10-2004-0004907.

English translation of Japanese translation of Nov. 22, 2005 Office Action issued in connection with corresponding Korean application No. 10-2004-0004907.

Untranslated Office Action issued by Korean Patent Office on Sep. 29, 2005 in connection with corresponding Korean appl. No. 10-2004-0004907.

* cited by examiner

DISPLAY APPARATUS DRIVE CIRCUIT HAVING A PLURALITY OF CASCADE CONNECTED DRIVER ICS

BACKGROUND OF THE INVENTION

1. Field of the Invention

The present invention relates to a display apparatus drive circuit, and in particular, to the display apparatus drive circuit having a plurality of cascade connected driver ICs.

2. Description of the Related Art

In recent years, a display panel grew in size, and attention is given to a display apparatus drive circuit for driving the display apparatus with a plurality of cascaded driver ICs.

As for such driver ICs, the ones shown in FIG. 7 are generally known as the related art (refer to Patent Document 1 for instance)

The driver ICs 701 shown in FIG. 7 are comprised of a phase adjustment circuit 702, a data latch circuit 703, a gray level selection circuit 704 and an output circuit 705.

The phase adjustment circuit 702 receives display data and a clock supplied from an LCD controller not shown and performs phase adjustment, and then conveys the data to a next-stage driver IC and also conveys the data to the data latch circuit 703. Based on the data latched by the data latch circuit 703, the gray level selection circuit 704 controls the output circuit 705 so as to have an unshown liquid crystal display panel driven by the output circuit 705.

As shown in FIG. 8, the phase adjustment circuit 702 is comprised of a flip-flop circuit 801, a PLL circuit (DLL circuit) 802 for generating a clock signal of ($\pi/2$) phase difference and a flip-flop circuit 803. The data supplied to the flip-flop circuit 801 is reshuffled with the clock signal, and then the data supplied to the flip-flop circuit 803 is latched with the clock signal shifted by ($\pi/2$) so as to adjust a phase shift between the data and the clock.

[Patent Document 1]

Japanese Patent Laid-Open No. 2001-324967

SUMMARY OF THE INVENTION

However, the driver ICs mentioned in Description of the Related Art perform phase adjustment between inputted data and clock signals, but do not perform the phase adjustment between outputted data and clock signals. Therefore, a margin decreases as a frequency of a clock becomes high so that a phase shift between the data conveyed from a driver IC to a next-stage driver IC and the clock signal becomes a serious problem. As for a duty ratio of the data, no control is exerted so that the duty ratio changes and a problem that the data is not correctly latched also arises. Furthermore, the phase adjustment among the start signal, data and clock signal is not performed, and so there arises a problem that correct data is not taken in when taking in the data in response to the start signal.

Therefore, an object of the present invention is to provide a display apparatus drive circuit comprising the driver ICs for performing the phase adjustment among the start pulse, data and clock to be conveyed to the next-stage while maintaining the duty ratio of the data.

The display apparatus drive circuit according to the present invention is the one having a phase adjustment circuit in a driver for driving a display apparatus based on inputted clock and data, wherein the phase adjustment circuit comprises a first synchronous delay circuit for adjusting the duty of the inputted clock and outputting it as a first clock, a second synchronous delay circuit for delaying the adjusted clock by a predetermined delay amount and outputting it as a second clock, a first holding circuit for holding and outputting the data in response to the first clock, and a second holding circuit for holding and outputting the data outputted from the first holding circuit in response to the second clock.

Thus, it is possible, by comprising the first and second synchronous delay circuits, to curb a collapse of the duty ratio of the clock and the phase shift between the clock and data so as to securely synchronize the data with the clock and take it in.

BRIEF DESCRIPTION OF THE DRAWINGS

This above-mentioned and other objects, features and advantages of this invention will become more apparent by reference to the following detailed description of the invention taken in conjunction with the accompanying drawings, wherein.

DETAILED DESCRIPTION OF THE PREFERRED EMBODIMENTS

Figure 1:
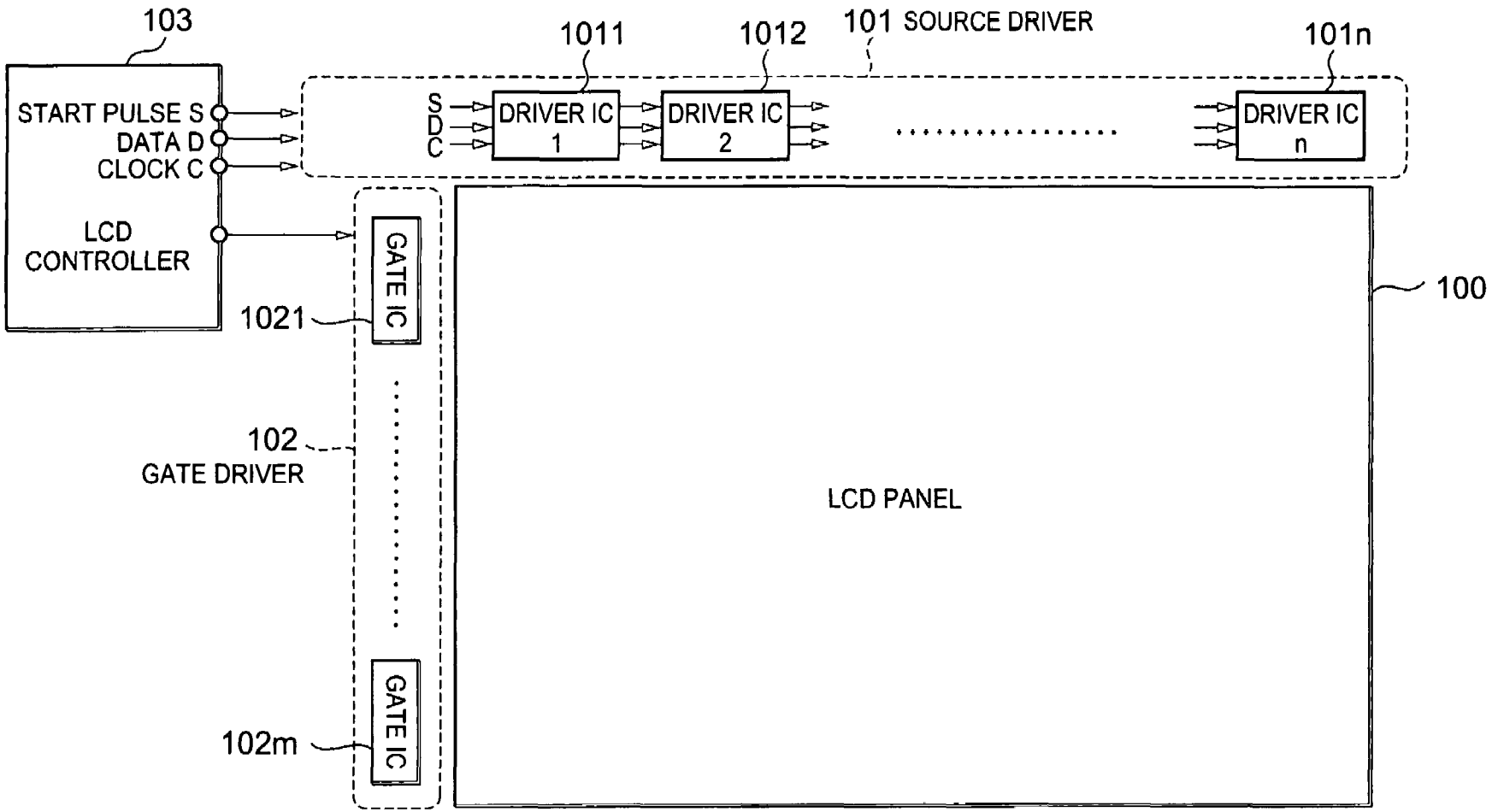
FIG. 1 is a system chart of a display apparatus of the present invention.

Hereafter, an embodiment of the present invention will be described by referring to the drawings. A concrete description will be given by using an embodiment.

[Embodiment]

As shown in FIG. 1, a system including a display apparatus drive circuit of the present invention is comprised of a display panel 100 of liquid crystal, plasma and so on, a display apparatus drive circuit (source driver) 101 for supplying pixel data to the display panel 100, a gate driver 102 for driving a gate of a pixel corresponding to one horizontal scanning line of the display panel 100 and supplying the data from the source driver 101 to the pixel, and a controller 103 for supplying a start pulse S, data D and a clock C to the source driver 101 and supplying a scanning horizontal synchronizing signal to the gate driver 102.

The source driver 101 is comprised of cascaded driver ICs 1011 to 101*n*. The driver IC 1011 receives the start pulse S, data D and clock C from the controller 103, and conveys these signals to the driver IC 1012 so that the driver ICs from the driver IC 1012 up to the driver IC 101*n* receive these signals from a preceding-stage driver and supplies them to a subsequent-stage driver IC.

Figure 2:
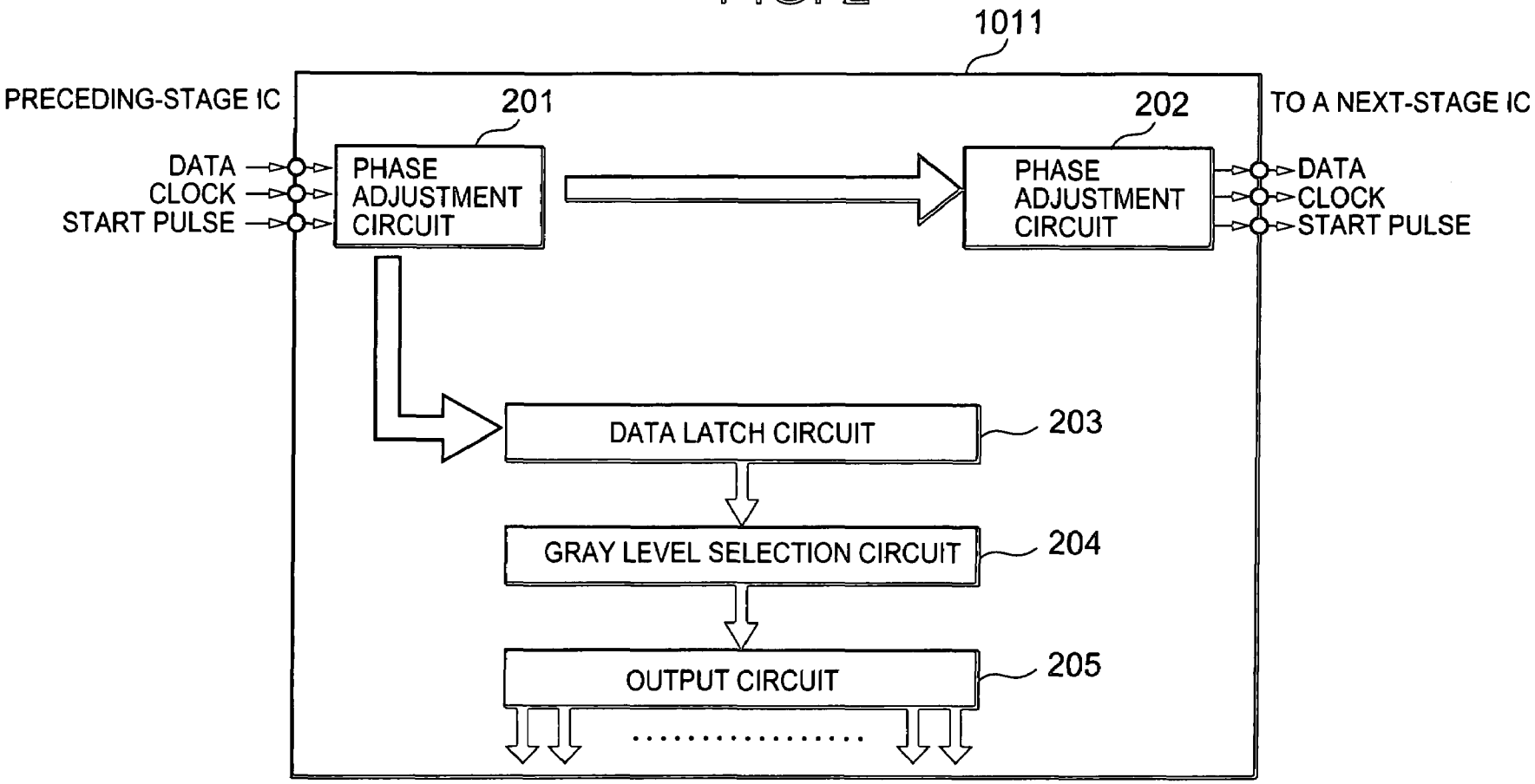
FIG. 2 is a block diagram of a driver IC according to an embodiment of the present invention.

As shown in FIG. 2, the driver IC 1011 comprises a start pulse input terminal for receiving the start pulse from the controller 103, a data input terminal for receiving data, a clock input terminal for receiving a clock, a phase adjustment circuit 201 for receiving the start pulse, clock and data from these input terminals, a data latch circuit 203 for taking in phase-adjusted data by synchronizing it with the clock, a gray level selection circuit 204 for selecting a gray level in response to output of the data latch circuit, and an output circuit 205 for driving the display panel 100 in response to the output of the gray level selection circuit. The data latch circuit 203, the gray level selection circuit 204 and the output circuit 205 are the same as those in the past, and so a detailed description thereof will be omitted.

The driver IC 1011 further comprises a phase adjustment circuit 202 for performing a phase adjustment again before conveying the data, clock and start pulse outputted from the phase adjustment circuit 201 to a next-stage driver IC.

Figure 3:
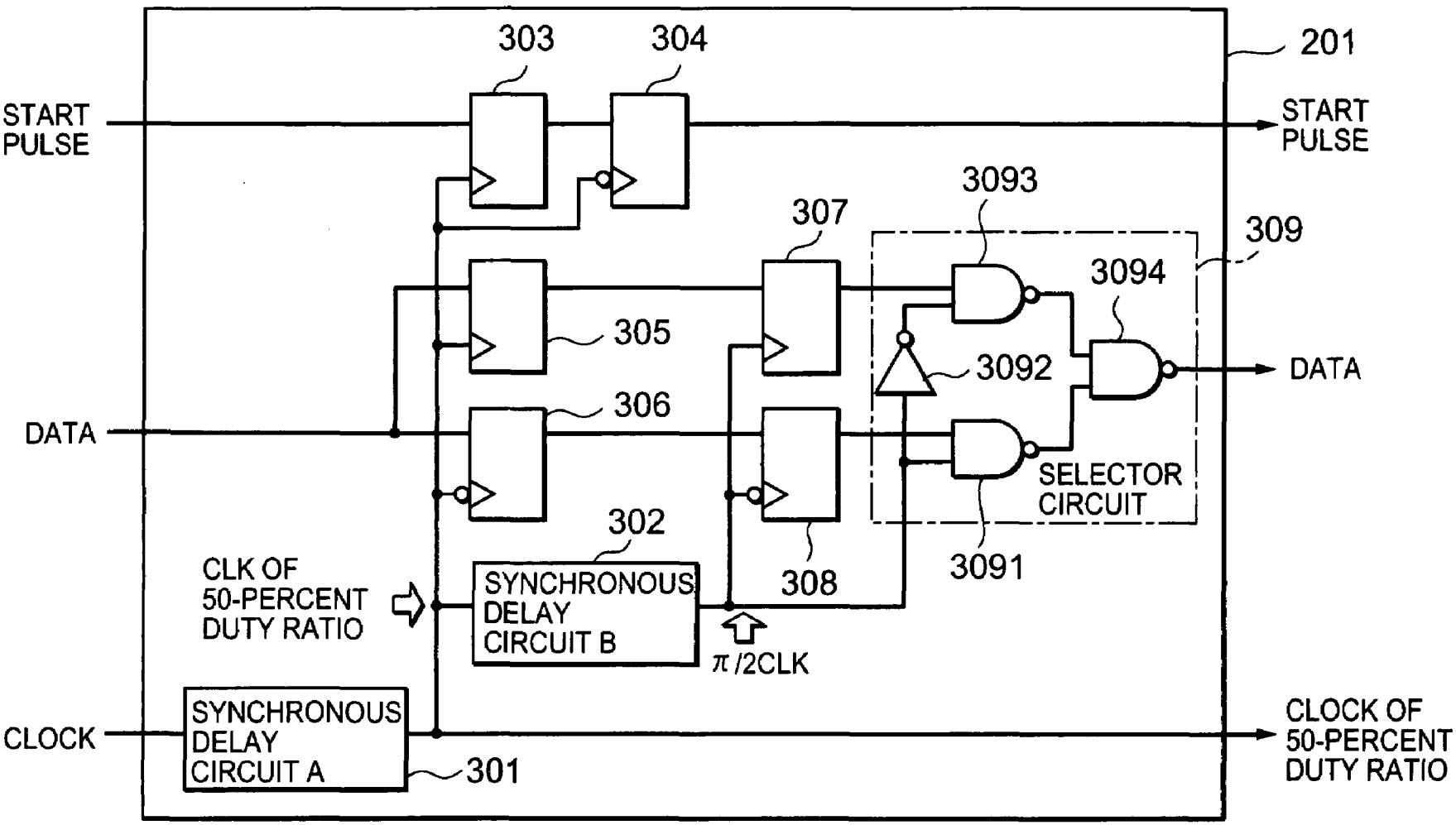
FIG. 3 is a circuit diagram of a phase adjustment circuit according to the embodiment of the present invention.

As shown in FIG. 3, the phase adjustment circuits 201 and 202 are comprised of a synchronous delay circuit A301, a synchronous delay circuit B302, latch circuits 303, 304, 305, 306, 307 and 308, and a selector circuit 309. The synchronous delay circuit A301 is comprised of a circuit for outputting an inputted clock signal by setting its duty ratio at 50 percent, and the synchronous delay circuit B302 is comprised of the circuit for outputting a delay clock signal by having the inputted clock signal shifted by ($\pi/2$).

Operation of these circuits will be described by using a timing chart in FIG. 4. Consideration is given to the case where the phase adjustment circuit 201 has the start pulse, the clock signal and the data synchronized with the clock signal inputted thereto. The duty ratio of the inputted clock signal is no longer 50 percent because the waveform is rounded off.

Once the clock signal, start pulse and data are supplied to the phase adjustment circuit 201, the latch circuit 303 latches the signal with a leading edge of the clock signal of the 50-percent duty ratio outputted from the synchronous delay circuit A301, and the latch circuit 304 latches the signal with a trailing edge of the clock signal of the 50-percent duty ratio. Therefore, the latch circuit 304 outputs the start pulse synchronizing to the clock and having one period length of the clock.

Likewise, the latch circuit 305 latches the signal on the leading edge of the clock signal of the 50-percent duty ratio, and the latch circuit 307 latches the clock signal of the 50-percent duty ratio on the leading edge of the delay clock signal having shifted by ($\pi/2$). Therefore, the latch circuit 307 outputs the data shifted by ($\pi/2$) against the leading edge of the clock outputted from the synchronous delay circuit A. The latch circuits 306 and 308 latch them on the trailing edge of the clock signal of the 50-percent duty ratio and on the trailing edge of the delay clock signal respectively. Therefore, the latch circuit 308 outputs the data shifted by ($\pi/2$) against the trailing edge of the clock outputted from the synchronous delay circuit A. Thus, as shown in FIG. 4, the clock signal of the 50-percent duty ratio and a delay clock signal having delayed the clock signal by ($\pi/2$) ($\pi/2$ clock) are generated inside the phase adjustment circuit.

The selector circuit 309 is comprised of NAND gates 3091, 3093, 3094 and an inverter 3092, and selectively outputs the data outputted from the latch circuits 307 and 308 in correspondence with a low level and a high level of the delay clock signal from the synchronous delay circuit B.

Figure 4:
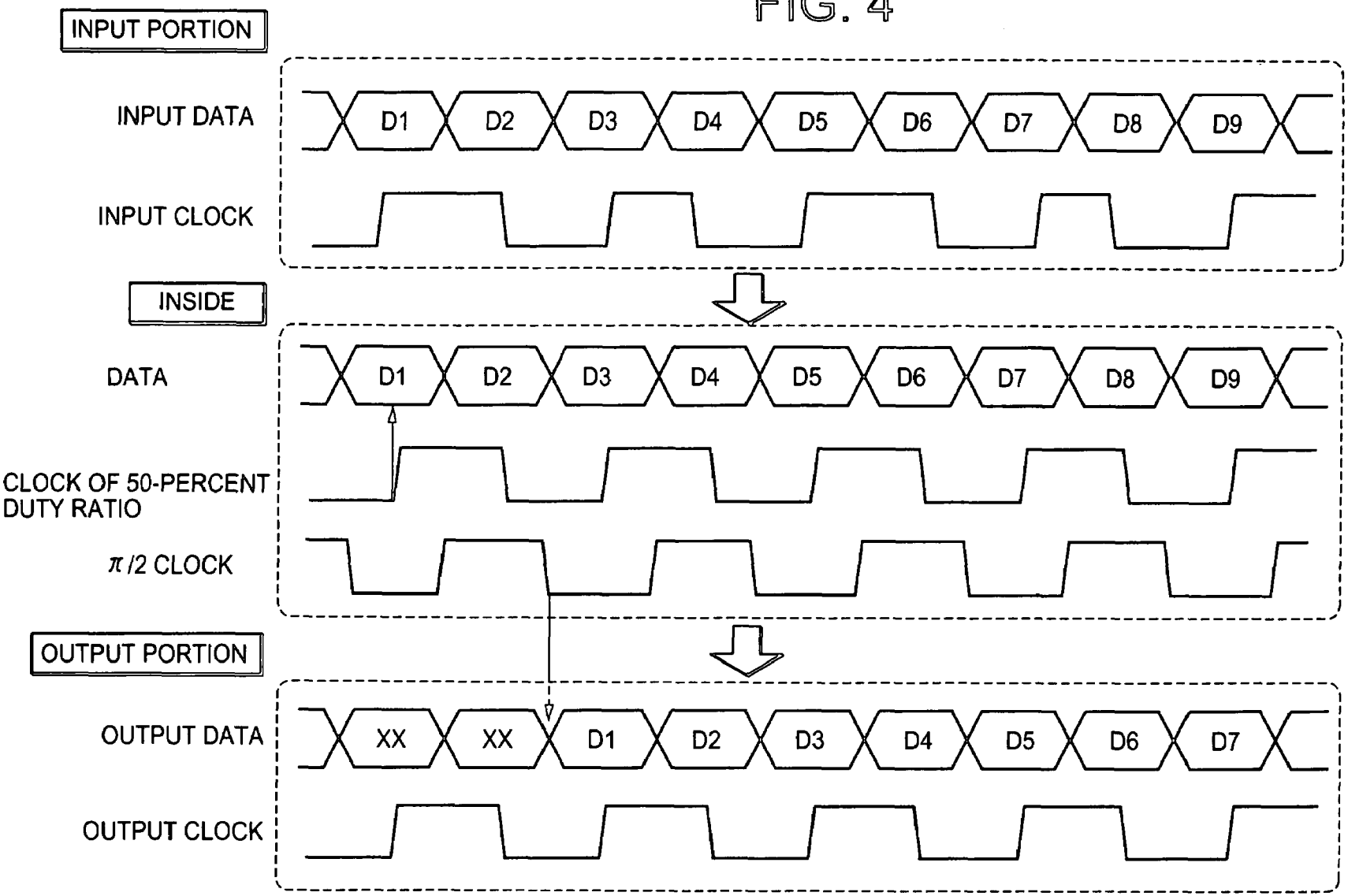
FIG. 4 is a timing diagram of signals in the phase adjustment circuit according to the embodiment of the present invention.
Figure 5:
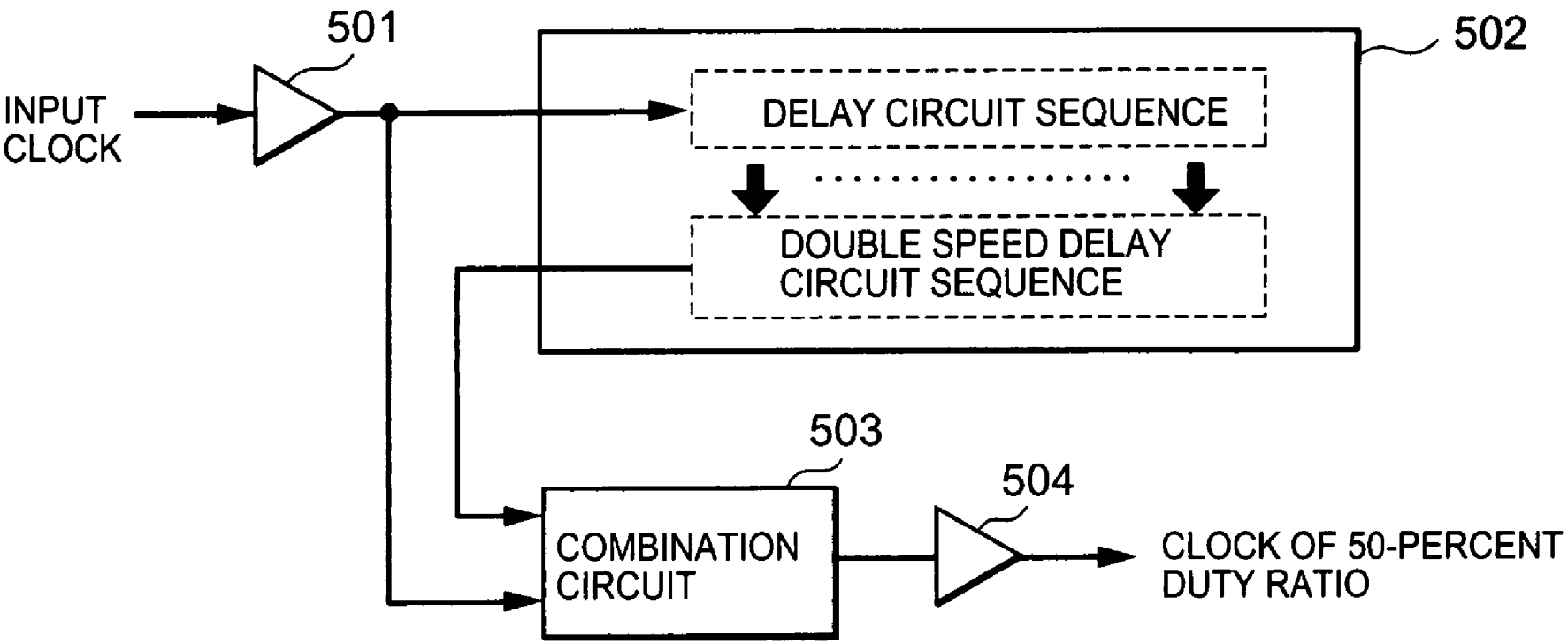
FIG. 5 is a block diagram of a synchronous delay circuit A of the present invention.
Figure 6:
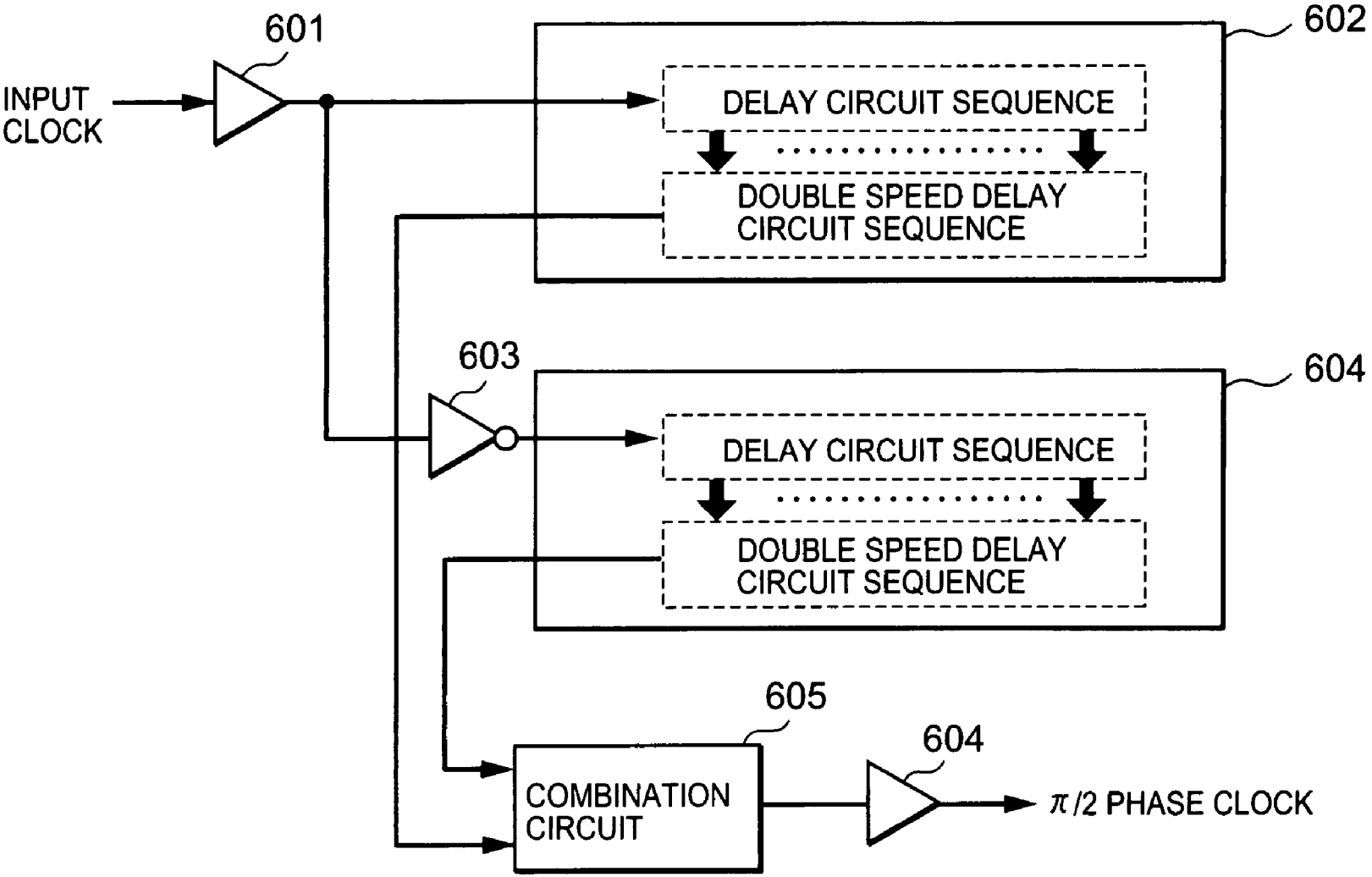
FIG. 6 is a block diagram of a synchronous delay circuit B of the present invention.
Figure 7:
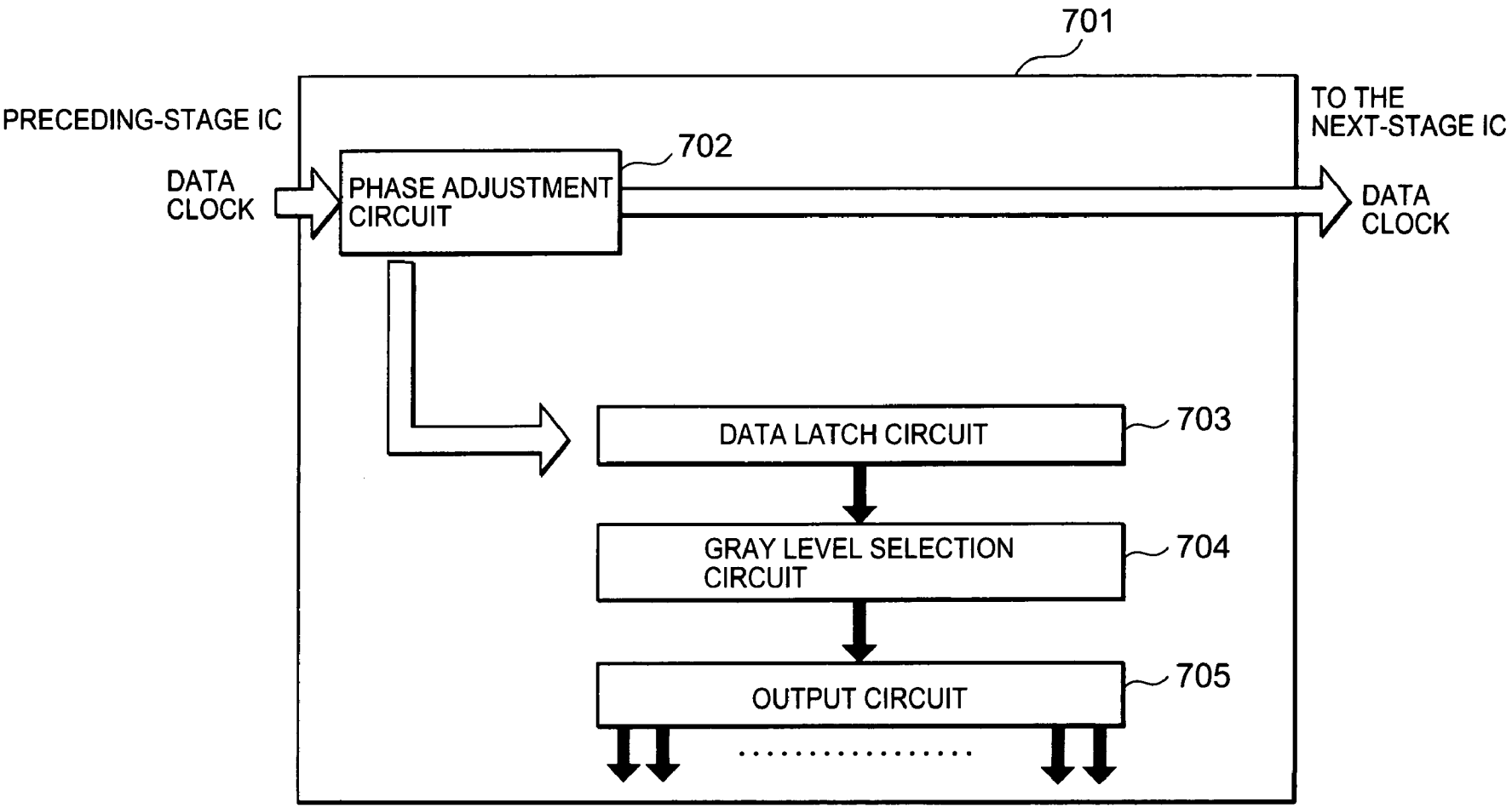
FIG. 7 is a block diagram of the driver IC in the past.
Figure 8:
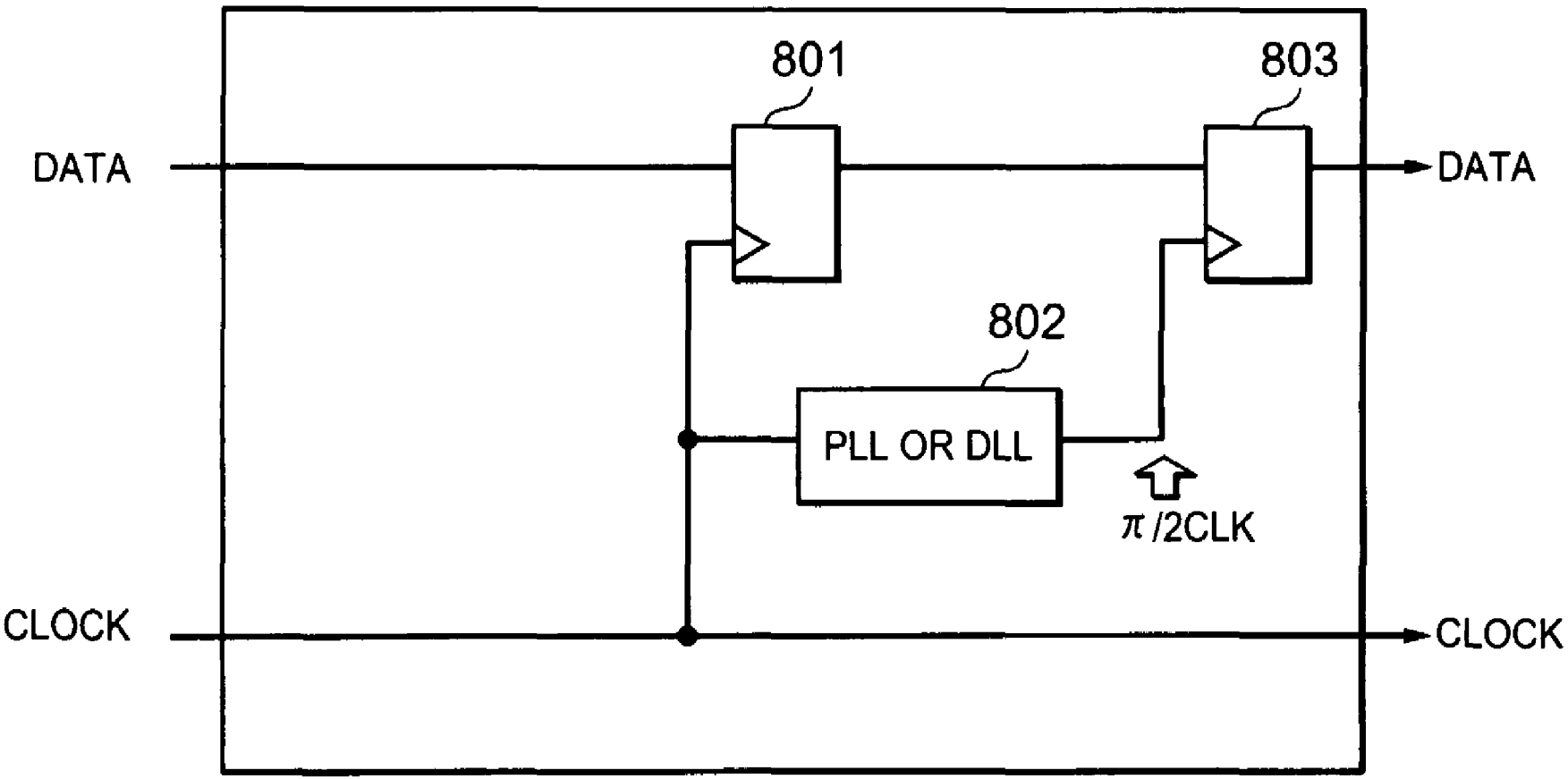
FIG. 8 is a circuit diagram of a phase adjustment circuit in the past.

Accordingly, as shown in FIG. 4, the phase adjustment circuit outputs the clock signal of the 50-percent duty ratio and the data shifted by ($\pi/2$) against the clock signal. For that reason, the data latch circuit 203 for receiving the clock signal and the data can securely take in the data in response to the leading edge of the clock (shifted by $\pi/2$ against data D1) at the center of the data D1, and securely take in the data in response to the trailing edge of the clock (shifted by $\pi/2$ against data D2) at the center of the data D2 for instance.

Thus, it is possible to securely latch the data in the driver ICs by using the synchronous delay circuit A301 for generating the clock of the 50-percent duty ratio and the synchronous delay circuit B302 for delaying the clock by ($\pi/2$).

Furthermore, there are the cases where the phase and duty ratio are shifted as to the data, clock and start pulse outputted from the phase adjustment circuit 201 provided in the proximity of the input terminal in the driver IC while being outputted from the driver IC to the next-stage driver IC. Therefore, it is possible to adjust the phase by providing the phase adjustment circuit 202 of the same configuration as the phase adjustment circuit 201 in the proximity of the output terminal of the driver IC so as to further improve accuracy of the signal conveyed to the next-stage driver IC.

As for the synchronous delay circuit A used inside the phase adjustment circuit, as shown in Japanese Patent Laid-Open No. 8-237091, it can be comprised of a buffer 501, a circuit 502 constituted by a delay circuit sequence and a double speed delay circuit sequence, a combination circuit 503 for combining the outputs from the buffer 501 and double speed delay circuit sequence, and a buffer 504 so as to supply the clock signal of the 50-percent duty ratio in the same phase as the inputted clock in a short time. Likewise, as shown in Japanese Patent Laid-Open No. 8-237091, the synchronous delay circuit B used inside the phase adjustment circuit can be comprised of circuits 602 and 604 constituted by the delay circuit sequence and double speed delay circuit sequence, a buffer 601, an inverter 603, a combination circuit 605 and a buffer 606 so as to supply the delay clock signal in the phase shifted by ($\pi/2$) against the inputted clock in a short time.

The driver IC of the present invention has the input terminals for having the data, clock and start pulse outputted from the preceding-stage driver IC or a controller and the output terminals for conveying the data, clock and start pulse to the next-stage driver IC, and it further has the phase adjustment circuit for the input placed in the proximity of the input terminal and the phase adjustment circuit for the output placed in the proximity of the output terminal so as to curb the phase shifts among the signals.

Furthermore, as shown in FIG. 2, it is desirable to have the input terminal and the output terminal provided on two opposed sides of the driver IC. It is because routes for conveying the data, clock and start pulse become approximately the same in the driver IC and so the phase shift does not easily arise.

Thus, according to the present invention, the phase adjustment circuit comprises the synchronous delay circuit for generating the clock signal of the 50-percent duty ratio from the inputted clock signal and the synchronous delay circuit for generating the clock signal delayed by ($\pi/2$) from the inputted clock signal. It is thereby possible to resolve a timing shift between the signals conveyed to an internal circuit and the next-stage driver IC so as to prevent wrong data from being taken in.

What is claimed is:

1. A display apparatus drive circuit having a phase adjustment circuit in a driver for driving a display apparatus based on inputted clock and data, said phase adjustment circuit comprising:

a first synchronous delay circuit for adjusting a duty of said inputted clock and outputting it as a first clock, a second synchronous delay circuit for delaying said adjusted clock by a predetermined delay amount and outputting it as a second clock, a first holding circuit for holding and outputting said data in response to said first clock, and a second holding circuit for holding and outputting the data outputted from said first holding circuit in response to said second clock.

2. The display apparatus drive circuit according to claim 1, wherein said phase adjustment circuit comprises a third holding circuit for holding and outputting a start pulse in response to said first clock and a fourth holding circuit for holding and outputting the start pulse outputted from said third holding circuit in response to an inversion signal of said first clock.

3. The display apparatus drive circuit according to claim 1, wherein said driver further comprises a data latch circuit for operating in response to the data outputted from said phase adjustment circuit and said first clock signal.

4. The display apparatus drive circuit according to claim 1, wherein said first synchronous delay circuit outputs said inputted clock by setting its duty ratio at 50 percent.

5. The display apparatus drive circuit according to claim 2, wherein said second synchronous delay circuit outputs said first clock by delaying it by $\pi/2$.

6. The display apparatus drive circuit according to claim 5, wherein said data latch circuit takes in data on a leading edge and a trailing edge of said first clock.

7. The display apparatus drive circuit according to claim 6, wherein said data latch circuit comprises a selector circuit for alternately outputting the data latched on said leading edge of said first clock and the data latched on said trailing edge thereof.

8. A display apparatus drive circuit having a plurality of drivers for driving a display apparatus based on inputted clock and data, each of said plurality of drivers comprising:

a first synchronous delay circuit for adjusting a duty ratio of the inputted clock and outputting it as a first clock, a second synchronous delay circuit for delaying said first clock by a predetermined delay amount and outputting it as a first delay clock, a first phase adjustment circuit for holding and outputting the data inputted based on said first clock and said first delay clock, a latch circuit for holding said held and outputted data in response to said first clock, a third synchronous delay circuit for readjusting the duty ratio of said first clock and supplying it as a second clock to a next-stage driver, a fourth synchronous delay circuit for delaying said second clock by the predetermined delay amount and outputting a second delay clock, and a second phase adjustment circuit for holding the data inputted based on said second clock and said second delay clock and outputting the held data to said next-stage driver.

9. The display apparatus drive circuit according to claim 8, further comprising a latch circuit for latching a start pulse in response to said first clock.

10. The display apparatus drive circuit according to claim 8, wherein it comprises a first latch circuit for latching and outputting the data inputted in response to said first clock and said first delay clock.

11. The display apparatus drive circuit according to claim 10, wherein it comprises a second latch circuit for latching and outputting the data inputted in response to said second clock and said second delay clock.

* * * * *